United States Patent [19]

Mathe et al.

[11] 4,427,251

[45] Jan. 24, 1984

[54] ELECTRICAL CONNECTOR HAVING DISPLACEABLE SIDEWALL TERMINAL ELEMENT

[75] Inventors: Istvan Mathe; Alan H. Kasper, both of Cicero, Ill.

[73] Assignee: Allied Corporation, Morris Township, Morris County, N.J.

[21] Appl. No.: 946,273

[22] Filed: Sep. 27, 1978

Related U.S. Application Data

[63] Continuation-in-part of Ser. No. 788,110, Apr. 18, 1977, abandoned.

[51] Int. Cl.[3] ..... H01R 13/38

[52] U.S. Cl. ..... 339/97 P

[58] Field of Search ..... 339/97 R, 97 P, 98, 339/99 R

[56] References Cited

U.S. PATENT DOCUMENTS

| | | | |
|---|---|---|---|
| 3,824,527 | 7/1974 | Evans | 339/97 R |
| 3,902,154 | 8/1975 | McKee | 339/223 R |
| 3,926,498 | 12/1975 | Hoppe, Jr. | 339/97 R |

*Primary Examiner*—Joseph H. McGlynn

[57] ABSTRACT

An electrical connector is disclosed having an insulation-opening contact member with at least one transversely displaceable sidewall that aligns itself parallel to both the opposing sidewall of the contact and the lateral surface of the mounting cavity of the connector. Insulation-opening protuberances extend inwardly from the displaceable sidewalls. The dielectric contact mount of the connector supports these protuberances and minimizes or prevents their lateral spreading during the connection operation.

19 Claims, 9 Drawing Figures

FIG. 6
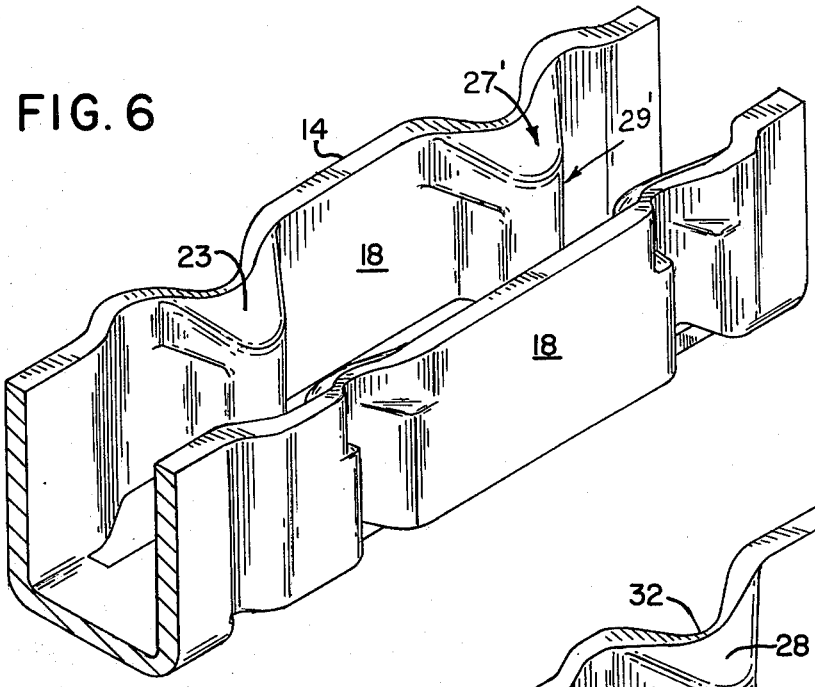
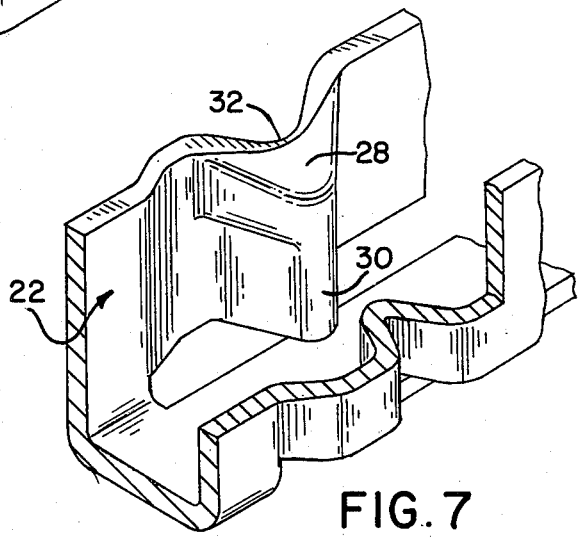
FIG. 7
FIG. 9
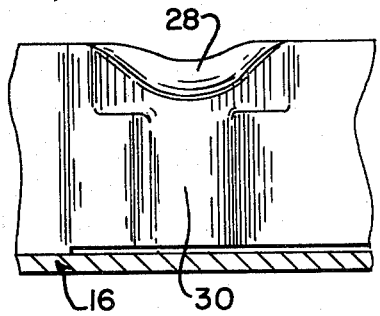
FIG. 8
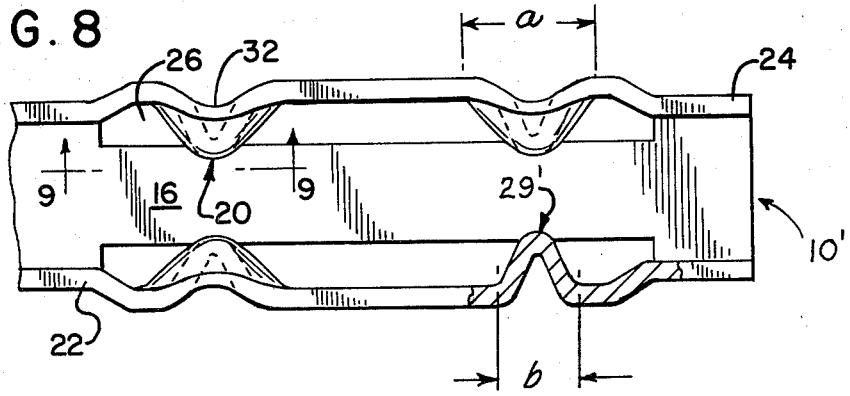

ELECTRICAL CONNECTOR HAVING DISPLACEABLE SIDEWALL TERMINAL ELEMENT

RELATED APPLICATION

This is a continuation-in-part of copending application Ser. No. 788,110, filed Apr. 18, 1977 and entitled "ELECTRICAL CONNECTOR HAVING DISPLACEABLE SIDEWALL TERMINAL ELEMENT", and now abandoned.

BACKGROUND OF THE INVENTION

This invention relates generally to electrical connectors of the insulation-opening or displacement type and, more particularly, to electrical connectors having contacts with displaceable or flexible sidewalls which hold and support the contacts in the cavities of the connectors in which the contacts are mounted.

Electrical connectors having insulation-piercing contacts are well known in the art and have met with considerable commercial success. Typical examples of such prior art connectors are illustrated in U.S. Pat. Nos. 3,867,005 and 3,926,498. The contacts employed in these connectors generally include terminal elements which sever or cut through the insulation and establish an electrical connection with the conductor without the need for any stripping or soldering operation. The insulation-piercing terminal elements typically include opposed cutting edges that sever and penetrate the insulation and serve as wiping surfaces, in some configurations, to make the necessary electrical connection with the conductor. The insulation-piercing terminal, therefore, serves both to sever the insulation and establish an electrical connection with the conductor. The disclosures of these aforementioned prior art patents describing the specific structural details of these prior art connectors, together with their specific manner of use, are incorporated herein by reference.

As mentioned above, the prior art insulation-piercing connectors have met with considerable commercial success. Nevertheless, certain problems arising in the fabrication of the miniaturized electrical components used in these connectors have resulted in designs which comprise the optimum performance characteristics which could otherwise be attained. For example, since the insulation-piercing contacts may be most economically manufactured by press and stamping operations, it is necessary to use sheet metal stock which is easily formable. Such sheet metal stock has a tensile strength which is less than that generally considered optimal for withstanding the forces encountered in the connection operation. Accordingly, certain of the structural components of prior art contacts which comprise the insulation-piercing terminal elements may be, in some instances, deformed or bent in the connecting operation to the point where proper electrical connection may be adversely affected. In addition, because of tolerance ranges required to minimize the cost of manufacture and to facilitate assembly, a small space often exists between the sidewalls of the contact and the lateral surfaces of the insert cavity in which the contact is mounted. Thus, the sidewalls have little or no lateral support and are susceptible to an outward lateral V-type deformation during the connecting operation, thereby further jeopardizing the quality of the electrical connection obtained. This deformation associcated with prior art connectors is characterized as "V-type" due to the fact that the terminal sidewalls spread only at their upper portions during the connecting operation. Thus, the terminal has a slight V-shape or upwardly diverging configuration when viewed in cross-section. This is undesirable since the terminated conductor has a tendency, in time, to lift or loosen from the contact terminal and may also result in a lack of uniform termination force on the conductor, and particularly on the individual strands of stranded core conductors.

Another problem associated with prior art insulation-piercing connectors is that they are not well suited to stranded core conductors. Oftentime, individual strands of such conductors snag on, or are severed by, the opposed cutting edges of the insulation-piercing terminal element. In addition, cold flow of the insulation subsequent to termination can result in movement of the individual strands and changes in the engagement area and force between the conductor and the sidewalls of the contact. Therefore, when utilizing stranded core conductors, the quality of both the electrical and mechanical connection attained with prior art connectors may be seriously impaired.

SUMMARY OF THE INVENTION

The present invention is, therefore, directed to an electrical connector having insulation-opening contacts which overcome the aforementioned problems relating to the deformation of the contacts' force bearing components. In addition, the contacts employed in the connectors of the present invention are designed to minimize the snagging and severing problems encountered, in some instances, in the connection of insulated, stranded core conductors.

In accordance with the general concepts of the present invention, a connector is provided having a cavity in which the individual contact members are mounted. The contact members include a terminal element having a pair of sidewalls adapted to receive an insulation-covered conductor. At least one of the sidewalls includes a portion which is transversely displaceable and maintains a generally parallel relationship with the opposing sidewall. Preferably, the displaceable portion moves from an initial, pre-assembly position wherein the transverse dimension of the contact is greater than the transverse dimension of the cavity, to a final, assembled position wherein the sidewalls are located within and engage the lateral surfaces of the cavity. Thus, the contact is designed with a terminal element including a displaceable longitudinal portion wherein one or both sidewalls are formed with an outward bow to positively engage and to apply a force to the lateral surfaces of the cavity. Alternatively, the displaceable portions of the contact sidewalls may have an initial dimension which is slightly less than the transverse dimension of the mounting cavity, but upon insertion of the conductor during termination the displaceable portions flex outwardly into generally parallel engagement with the lateral surfaces of the cavity. This arrangement, however, is the functional equivalent of the preferred embodiment since, in either case, the forces applied during termination are transmitted, at least in part, to the connector structure and are not borne by the contact terminal itself. In addition, the contact includes at least one pair of protuberances which form a conductor-receiving notch adapted to open or displace the insulation and make electrical connection with the conductor. The protuberances extend inwardly from the sidewalls of the terminal element and are located at the displaceable or bowed portions thereof. Finally, the various structural components of the contact are dimensioned relative to each other and the conductor being terminated to minimize the changes in termination resistance which typically occurs when stranded core conductors are terminated with conventional contacts.

The contact element employed in the connector of the present invention overcomes the problems associated with prior art devices since the sidewalls of the contact which must withstand the lateral forces generated by the insertion of the insulated conductor are designed to maintain a generally parallel alignment with one another and positively engage and bear against the lateral surfaces of the contact mounting cavity. In this manner the quality of the termination is greatly enhanced. Moreover, the strength and rigidity of the relatively thick walls of the contact mount of the connector are utilized to withstand the connection forces, and a contact of relatively low tensile strength may be employed without adversely affecting the quality or character of the electrical connection obtained. Therefore, realtively low tensile strength sheet metal stock may be employed in the contact elements, thereby greatly facilitating their fabrication.

BRIEF DESCRIPTION OF THE DRAWINGS

The novel features which are believed to be characteristic of the invention are set forth in the appended claims. The invention itself, however, together with further objects and attendant advantages thereof, will be best understood by reference to the following description taken in connection with the accompanying drawings in which:

FIG. 6 is a view similar to that of FIG. 1 but showing a preferred protuberance embodiment for the contact terminal of the present invention;

FIG. 7 is a fragmentary perspective view of the terminal element of FIG. 6;

FIG. 8 is a plan view of the terminal element shown in FIG. 6; and

FIG. 9 is a fragmentary side view of the terminal element shown in FIG. 6.

DETAILED DESCRIPTION OF THE PREFERRED EMBODIMENTS

Figure 1:
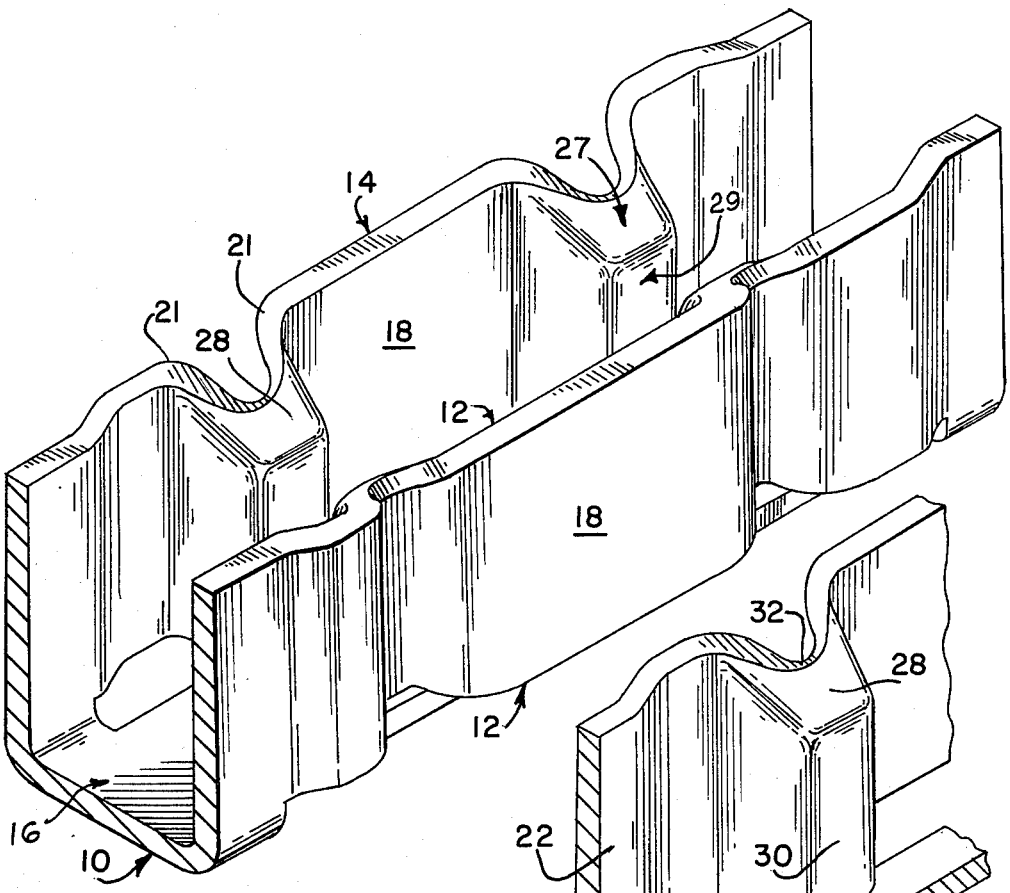
FIG. 1 is a perspective view illustrating a terminal element of a contact member constructed in accordance with the present invention and for use in an electrical connector.
Figure 2:
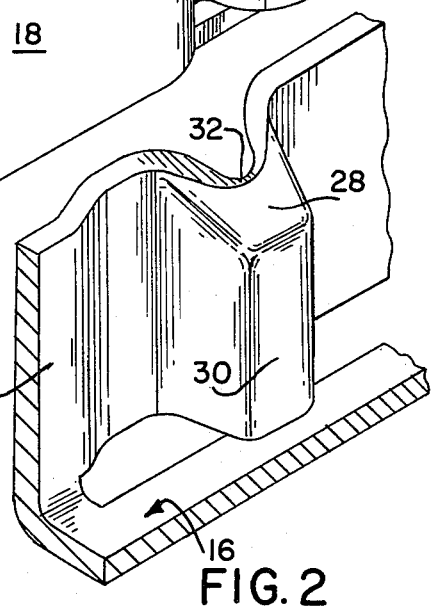
FIG. 2 is a fragmentary perspective view of the terminal element of FIG. 1 illustrating in greater detail one of the protuberances or detents which act to open or displace the insulation and make electrical connection with the conductor.
Figure 3:
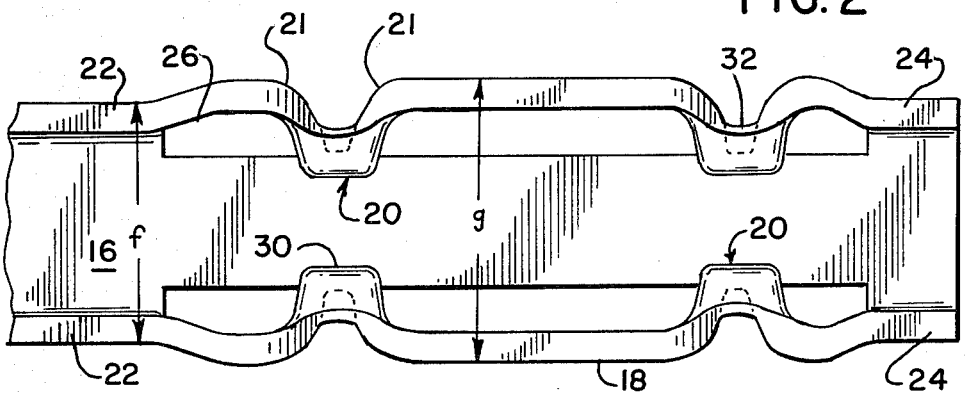
FIG. 3 is a plan view of the terminal element shown in FIG. 1.

Referring now to FIGS. 1 through 3 of the drawings, a terminal element 10 of a contact member is illustrated comprising a channel having an elongated U-shaped configuration. The channel includes opposed sidewalls 12 and 14 and a bottom wall 16 which joins at least a portion of the sidewalls 12 and 14 to one another. Each sidewall 12 and 14, respectively, includes a displaceable portion 18 which carries at least one inwardly extending protuberance or detent 20. The protuberances 20 on each sidewall 18 are aligned to form conductor-receiving notches adapted to penetrate the insulation and establish electrical connection with a conductor. The portions 18 of each sidewall are displaceable transversely relative to one another. In their initial position, as can be most clearly seen in FIG. 3, the portions 18 of each sidewall 12 and 14, respectively, are bowed outwardly. Preferably, the displaceable portions 18 are positioned intermediate generally stationary end portions 22 and 24. In addition, portions 18 are separated from bottom wall 16 by apertures 26, thereby allowing their transverse displacement. The stationary end portions, 22 and 24, together with the bottom wall 16, give the terminal element 10 the desired rigidity for successful operation in the connector.

The protuberances 20 are integrally formed in the displaceable portions 18 of the respective sidewalls and include an upper, insulation-displacing portion 27 having an inclined surface 28 and a lower conductor wiping portion 29 having a generally planar wiping surface 30. The inclined surfaces 28 of each respective pair of protuberances 20 form an entryway to the conductor-receiving notch formed by the protuberances. The inclined surfaces 28 terminate in an upper, cutting edge 32 which is remote from the wiping surface 20 and which serves to initially penetrate the insulation on the conductor as it is inserted into the terminal element 10 of the contact member. In any given conductor-receiving notch, the cutting edges 32 are spaced a distance greater than the diameter of the conductor core but less than the diameter of the conductor insulation. Thus, the protuberances 20 are approximately half closed at their conductor-receiving upper surfaces 28.

It will be appreciated by those skilled in the art that the smooth inclined surface 28, together with the location of cutting edge 32 spaced or remote from the wiping surface 30 and the longitudinal center line of the terminal element 10, serves to enhance the quality of the connection obtained since the snagging or "hang-up" encountered with standard conductors is substantially eliminated. In addition, since the displaceable portions 18 of each sidewall are separated from the bottom wall 16 by the slots or apertures 26, the displaceable portions remain generally perpendicular to bottom wall 16 regardless of their relative positions. The wiping surfaces 30 of protuberances 20 also remain generally parallel to one another. Thus, the V-type deformation associated with prior art structures is eliminated with the contact terminal element of the present invention.

It should also be noted that the inclined surfaces 28 are generally planar and sufficiently wide to insure the proper removal of the bulk of insulation from the metallic core of the conductor as it is forced into the terminal element 10. The surfaces 30 are also generally planar and sufficiently wide so as to remove any residual insulation film from the core and to provide a clean surface on the core to establish optimal electrical contact.

Figure 4:
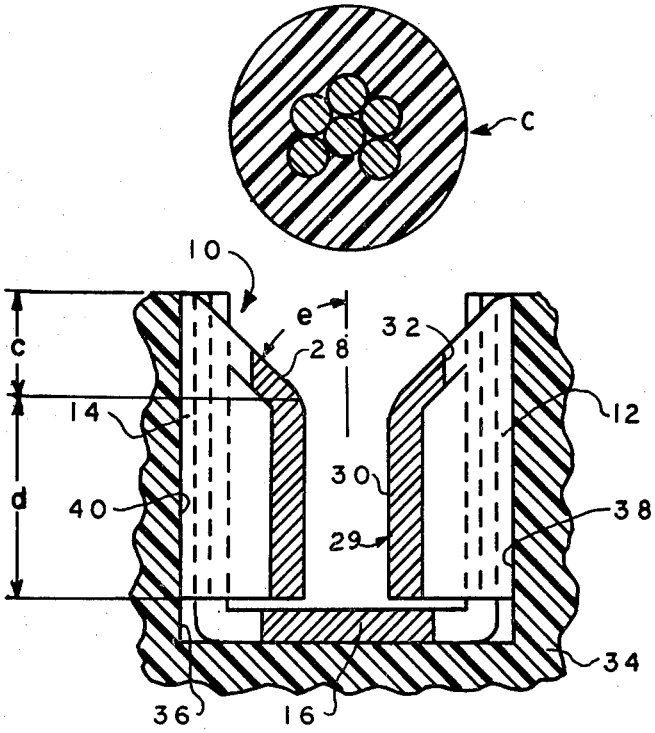
FIG. 4 is a partial cross-sectional view showing the contact member constructed in accordance with the present invention in the operating position within a contact mounting cavity of an electrical connector and further showing an insulated stranded core conductor positioned above the contact member immediately prior to the connection operation.
Figure 5:
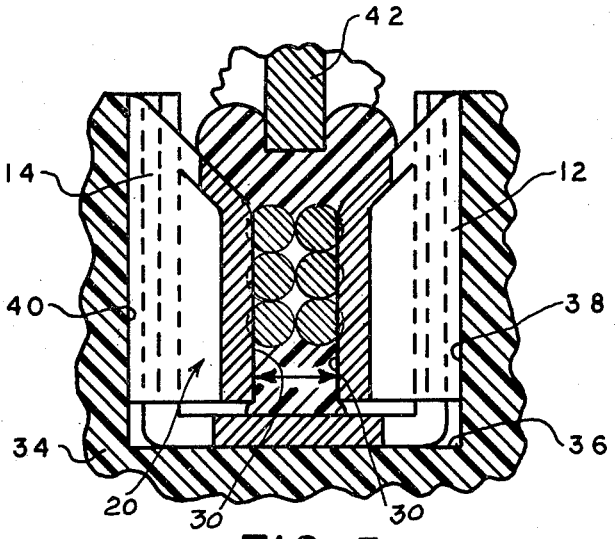
FIG. 5 is a cross-sectional view similar to that of FIG. 4 showing the insulated stranded coreconductor in final position within the contact member with the protuberances of the contact member having opened and displaced the insulation and making electrical connection with the stranded core of the conductor.

In addition to these aforementioned features, contacts made in accordance with the present invention also include a self-adjusting capability which enhances their use with either solid or stranded core conductors. Due to the design of the displaceable portions 18, the base portions 21 of each protuberance are able, under sufficient load, to spread slightly. As a result the spacing or gap between opposing protuberances will increase. In order to take advantage of this capability, the contact terminal 10 is fabricated with a protuberance spacing to accommodate stranded core conductor, and the termination is effected as shown in FIGS. 4 and 5 with little or no deformation of the protruberance base portions 21. When this same contact terminal is used to terminate solid core conductor, the interference between the protuberances 20 and the core is greater than with stranded core. Thus, greater forces are realized in terminating solid core conductor with the result that the protuberance base portions spread from one another, enlarging the gap between opposing protuberances. This self-adjusting or yielding action, is desirable since it reduces scoring on the solid core.

An alternative and preferred construction for the protuberances 20 is illustrated in FIGS. 6–9. In accordance with this embodiment, the insulation displacing portion 27' is enlarged such that its dimension along the longitudinal axis of the terminal element 10' (arrow a, FIG. 8) is greater than the same dimension (arrow b, FIG. 8) of the conductor wiping portion 29'. Accordingly, insulation is displaced or stripped from a longer segment of the conductor than is actually engaged by the conductor wiping surface 30'. By way of example, when the contact terminal 10 is employed in a ribbon connector, the longitudinal dimension of the insulation displacing portion 27' at arrow a of FIG. 8 may be about 0.040–0.042 inch and the longitudinal dimension of the conductor wiping portion 30' at arrow b of FIG. 8 may be less than about 0.030 inch. Since the wiping portion 30' is centrally located with respect to the insulation-displacing portion 27', the wiping portion 30' will engage the exposed conductor at a point remote from the edges of the insulation. This insures that the edges of the insulation will not interfere with the engagement of wiping portion 30' on the conductor core and results in an improved electrical connection.

It has also been discovered that the dimensions of the protuberances 20, relative to the size of the insulated conductor C, play an important part in optimizing the quality of the termination. In order to assure proper insulation removal, the insulation-displacing portion 27 of the protuberance should have a vertical dimension (arrow c, FIG. 4) at least as great as the radius of the insulated conductor being terminated. In addition, in order to properly "clean" or "wipe" the exposed conductor core, the conductor wiping portion 29 of the protuberance should have a vertical dimension (arrow d, FIG. 4) at least as great as the diameter of the insulated conductor. Preferably, the wiping dimension (arrow d) is 0.010 inch greater than the diameter of the insulated conductor C. Again, as an example only, when the terminal 10 is employed in a conventional ribbon connector to terminate a 28 gage stranded core insulated conductor with an outside diameter of 0.032 inch, the dimension c should be at least about 0.016 inch, and dimension d should be in the range of about 0.042 inch or more.

Finally, the inclined surface 28 should form an angle with the vertical longitudinal plane of the terminal element 10 (angle e, FIG. 4) in the range of 30° to 40° and optimally about 35°.

It should also be noted that the protuberances 20 in this embodiment preferably have a rounded configuration at the internal surfaces of the insulation-displacing portion 27' and the conductor wiping portion 29'. It has been found that such a configuration is more easily formed without loss of performance.

The above-described terminal element 10 forms a portion of a contact member which is used in conjunction with a contact mount of an electrical connector. The specific structural features of the contact mount and the other connector components and the assembly of the contact member with the connector are illustrated in greater detail in the abovementioned U.S. Pat. No. 3,867,005 the disclosure of which has been incorporated herein by reference. Generally, the contact member includes both a terminal element and an active contact element which are disposed within a contact mount 34 made of dielectric material. The contact mount includes an elongated contact mounting cavity 36 having a generally U-shaped configuration with inner and outer ends, the terminal element 10 of the contact member being disposed within the outer end of the cavity.

It will be appreciated that in order to facilitate the assembly of the connector it is necessary that the contact mounting cavity and the terminal element be dimensioned within narrow tolerances. Nevertheless, in prior art connectors a small space often exists between the lateral surfaces of the contact mounting cavity and the sidewalls of the terminal element. As mentioned above, this spacing is undesirable in that it allows the tops of the sidewalls to spread, leaving a V-shaped cross-section upon the insertion of the insulated conductor therebetween. The connector constructed in accord with the present invention overcomes this problem.

In order to insure that the terminal element 10 has sufficient lateral support to withstand the forces encountered during connection of the conductor C, the portions 18 of the terminal element 10 are bowed outwardly to have an initial, pre-assembly transverse dimension which is greater than the minimum transverse dimension of the contact mounting cavity 36. Of course, the transverse dimension of the terminal element at the stationary end portions 22 and 24 is less than that of the cavity 36. Exemplary dimensions for the terminal element 10, for use in a cavity having a 0.052–0.054 inch width, include a width at the stationary portions (arrow f, FIG. 3) of 0.051 inch maximum and an initial pre-assembly width at the displaceable portion (arrow g, FIG. 3) of 0.053–0.056 inch. Accordingly, when the contact member is inserted into the contact mount 34 during assembly of the connector, the portions 18 of the terminal element 10 are displaced inwardly to a final, assembled position in which the sidewalls 12 and 14, at the displaceable portions 18, bear directly against the lateral surfaces 38 and 40 of the cavity 36. Thus, the terminal element 10 is disposed within the contact mounting cavity 36 in press-fit relationship without any spacing between the lateral surfaces 38 and 40 and the sidewall 12 and 14. In addition, the protuberances 20 have substantial support at their base portions 21 where the protuberances abut their respective sidewalls. As will be noted from the above exemplary dimensions, it is possible due to the required manufacturing tolerances that a contact made in accordance with the present invention may have displaceable portions whose initial transverse dimension is slightly less than that of the cavity 36. This arrangement, however, is functionally equivalent to the preferred embodiment since the displaceable portions of the terminal sidewalls will immediately flex outwardly into the desired press fit relationship upon insertion of the conductor being terminated.

As is clearly illustrated in FIG. 5, when the insulated conductor C is forced into the terminal element 10 by means of an appropriate insertion tool 42, the insulation is displaced or stripped from the core of the conductor and the wiping surfaces 30 of protuberances 20 engage the core to provide the desired electrical connection. The core strands in direct contact with the wiping surfaces 30 are slightly scored as a result of the wiping travel under force, but the scoring is minimal and tends to provide an improved electrical connection with little adverse mechanical effect.

The construction of the terminal element 10 in accordance with the present invention, prevents or greatly reduces the outward displacement of sidewalls 12 and 14 and completely eliminates the V-type deformation as is sometimes encountered in prior art connectors. Thus, the transverse dimension of the conductor-receiving notch (represented by the double headed arrow in FIG. 5) remains generally constant and uniform and the wiping surfaces 30 remain generally parallel during the connection operation, thereby insuring proper electrical connection even with stranded core conductors. In addition, the cutting edge 32 on each protuberance 20 is spaced a sufficient distance outwardly from the centerline of terminal element 10 to insure that the stranded core of the conductor does not hang-up. Moreover, the danger of individual strands of the core being severed by the cutting edge 32 is greatly reduced.

Since the connector of the present invention relies upon the strength of the dielectric contact mount to support the sidewalls of the terminal element, the contacts may be fabricated from relatively low tensile strength sheet metal stock without adversely affecting the quality of the electrical connection obtained. In addition, since the sidewalls of the terminal element are transversely displaceable, the dimensional variations in both the contacts and contacting mounting cavities become less critical.

Of course, it should be understood that various changes and modifications to the preferred embodiments described herein will be apparent to those skilled in the art. For example, the displaceable portion 18 may be used in only one sidewall of the terminal element and structural configuration other than the disclosed three-sided channel may be employed to position and align the opposed sidewalls 12 and 14. Such changes and modifications can be made without departing from the spirit and scope of the present invention and without diminishing its attendant advantages. It is, therefore, intended that such changes and modifications be covered by the following claims.

We claim:

1. An insulation-piercing contact mounted in a cavity of an electrical connector, comprising:

a channel including a pair of sidewalls adapted to receive an insulation covered conductor, at least one of said sidewalls including a portion displaceable from an initial position wherein the transverse dimension of said channel at said portion is greater than the transverse dimension of said cavity, to a final position wherein said sidewalls are located within and engage the lateral surfaces of said cavity; and at least one pair of protuberances forming a conductor-receiving notch adapted to open and displace said insulation and make electrical connections with the conductor, one of said protuberances extending inwardly from the displaceable portion of each said sidewall.

2. The contact of claim 1 wherein said displaceable portions of said sidewalls are positioned intermediate generally stationary end portions, the transverse dimension of said channel at said end portions being less than that of said cavity.

3. The contact of claim 1 wherein each said protuberance comprises a detent integrally formed in a respective sidewall and includes an insulation displacing portion and a conductor wiping portion, said insulation displacing portion having a dimension along the longitudinal axis of said channel greater than that of said conductor wiping portion.

4. The contact of claim 1 wherein each said protuberance comprises a detent integrally formed in a respective sidewall and includes an insulation-displacing portion and a conductor wiping portion, said insulation-displacing portion having a size and configuration such that said insulation is displaced from a substantially greater segment of said conductor than is contacted by said conductor wiping portion.

5. The contact of claim 1 wherein each of said protuberance comprises a detent integrally formed in a respective sidewall and includes an insulation displacing portion having an inclined surface and a conductor wiping portion, said insulation-displacing portion having a vertical dimension not less than the radius of the insulation-covered conductor, said conductor-wiping portion having a vertical dimension not less than the diameter of the insulation-covered conductor, and said inclined surface disposed about thirty-five degrees from the vertical longitudinal plane of said channel.

6. The contact of claim 1 wherein each said protuberance comprises a detent integrally formed in a respective sidewall and including an inclined surface and a conductor wiping surface, said inclined surfaces forming an entryway to said notch and having an insulation-piercing edge positioned remote from said wiping surfaces.

7. The contact of claim 6 wherein said wiping surfaces are generally planar and parallel to each other with said displaceable portions in either the initial or final positions.

8. The contact of claim 1 wherein said channel further includes a bottom wall joining said sidewalls.

9. The contact of claim 8 wherein said displaceable portions of said sidewalls are separate from and movable relative to said bottom wall.

10. An electrical connector for interconnecting electrical circuits including insulation covered conductors comprising:

a contact mount of dielectric material having at least one elongated contact mounting cavity with inner and outer ends; and at least one contact member mounted in said cavity, each contact member including an active contact element and a terminal element disposed within the outer end of said cavity;

said terminal element comprising a U-shaped channel including opposite sidewalls with portions transversely displaceable from an initial pre-assembly position wherein the transverse dimension of said channel at said displaceable portions is greater than that of said cavity to a final position wherein said displaceable portions are located within said cavity and engage the lateral surfaces of said cavity in press-fit relationship, and at least one pair of protuberances forming a conductor-receiving notch adapted to penetrate said insulation and make electrical connection with the conductor, one of said protuberances extending inwardly from the displaceable portion of each said sidewall.

11. The connector of claim 10 wherein said terminal element also includes a bottom wall joining said opposite sidewalls, said displaceable portions of said sidewalls being separate from and movable relative to said bottom wall.

12. The connector of claim 10 wherein said displaceable portion of said sidewalls are positioned intermediate generally stationary end portions, the transverse dimension of said channel at said end portions being less than that of said cavity.

13. The connector of claim 10 wherein said protuberances each comprises a detent integrally formed in its respective sidewall and having a generally planar wiping surface, the wiping surfaces of each pair of protuberances being parallel to each other in said final position.

14. The connector of claim 13 wherein each said detent also includes an inclined surface having an upper insulation-piercing edge located remote from said wiping surface, the inclined surfaces of each pair of protuberances forming an entryway for said conductor-receiving notch.

15. An insulation-piercing contact mounted in a cavity of an electrical connector, comprising:

a channel having a pair of sidewalls adapted to receive an insulation-covered conductor longitudinally therebetween, said channel including a longitudinal portion relative to the axis of said conductor wherein said sidewalls are bowed outwardly to positively engage and apply a force to the lateral surfaces of said cavity; and at least one pair of protuberances forming a conductor-receiving notch adapted to penetrate said insulation and make electrical connection with the conductor, one of said protuberances extending inwardly from each said sidewall at said longitudinal portion of said channel.

16. The contact of claim 15 wherein each said protuberance comprises a detent integrally formed in a respective sidewall and including a wiping surface, the wiping surfaces of a respective pair of protuberances being generally parallel to each other.

17. In an electrical connector for use in making an electrical connection to an insulation-covered conductor and including a contact member mounted in a cavity thereof and having a pair of opposed sidewalls each of which carries at least one inwardly extending detent adapted to pierce the insulation and make electrical contact with the conductor, the improvement comprising:

said contact member having a longitudinal portion relative to the axis of said conductor supporting said detents wherein said sidewalls are bowed outwardly to positively engage and apply a force to the lateral surfaces of said cavity.

18. An insulation-piercing contact mounted in a cavity of an electrical connector for electrical connection to an insulation covered conductor, comprising:

a pair of opposed sidewalls adapted to receive the insulated conductor longitudinally therebetween, at least one of said sidewalls including a transversely displaceable portion which upon termination of the insulation covered conductor permits said sidewalls to engage and remain generally parallel to the lateral surfaces of said cavity; and at least one pair of protuberances forming a conductor-receiving notch adapted to penetrate said insulation and make electrical connection with the conductor, one of said protuberances extending inwardly from the displaceable portion of said sidewall, and both said protuberances including innermost conductor wiping surfaces disposed generally parallel to one another when said sidewalls engage said lateral surfaces upon termination of the insulation covered conductor.

19. An electrical connector for interconnecting electrical circuits including insulation covered conductors comprising:

a contact mount of dielectric material having at least one elongated contact mounting cavity with inner and outer ends; and at least one contact member mounted in said cavity, each contact member including an active contact element and a terminal element disposed within the outer end of said cavity;

said terminal element comprising a U-shaped channel including opposite sidewalls with portions transversely displaceable from an initial pre-assembly portion wherein the transverse dimension of said channel at said displaceable portions is less than or greater than that of said cavity to a final position upon termination of said insulation covered conductor wherein said displaceable portions are located within said cavity and engage the lateral surfaces of said cavity in press-fit relationship, and at least one pair of protuberances forming a conductor-receiving notch adapted to penetrate said insulation and make electrical connection with the conductor, one of said protuberances extending inwardly from the displaceable portion of each said sidewall and both said protuberances having innermost conductor wiping surfaces disposed generally parallel to one another when said displaceable portions are in said final position.

* * * * *